United States Patent [19]

Cornell et al.

[11] 4,373,659

[45] Feb. 15, 1983

[54] STACKABLE CARTON WITH LID

[75] Inventors: William F. Cornell, Fresno; John P. Vear, Salinas, both of Calif.; E. Anthony Pascuzzi, Arden Hills, Minn.

[73] Assignee: Champion International Corporation, Stamford, Conn.

[21] Appl. No.: 239,897

[22] Filed: Mar. 3, 1981

Related U.S. Application Data

[63] Continuation-in-part of Ser. No. 89,885, Oct. 31, 1979, abandoned, which is a continuation-in-part of Ser. No. 936,612, Aug. 24, 1978, Pat. No. 4,175,691.

[51] Int. Cl.[3] ..... B65D 5/26; B65D 13/00

[52] U.S. Cl. ..... 229/32; 229/34 R; 229/31 R

[58] Field of Search ..... 229/6 R, 6 A, 23 R, 229/30, 31 R, 31 FS, 32, 33, 34 R, 34 A, 52 B

[56] References Cited

U.S. PATENT DOCUMENTS

| | | | |
|---|---|---|---|
| 2,809,775 | 10/1957 | White | 229/34 R |
| 2,894,672 | 7/1959 | Bamberg | 229/27 |
| 2,965,279 | 12/1960 | Campbell | 229/6 A |
| 3,058,643 | 10/1962 | Wilson | 229/23 R |
| 3,196,021 | 7/1965 | Oar | 229/6 R |
| 3,373,921 | 3/1968 | Crane | 229/23 R |
| 3,448,914 | 6/1969 | Scholz | 229/32 |
| 3,536,249 | 10/1970 | Houston | 221/31 FS |
| 3,940,053 | 2/1976 | Putman | 229/44 R |
| 4,046,309 | 9/1977 | Paggiali | 229/36 |
| 4,053,098 | 10/1977 | Baptist | 229/23 R |
| 4,139,146 | 2/1979 | Bamberg | 229/32 |
| 4,169,553 | 10/1979 | Cain | 229/32 |
| 4,175,691 | 11/1979 | Cornell et al. . | |
| 4,236,740 | 12/1980 | Sorenson | 229/33 |
| 4,245,773 | 1/1981 | Stollberg | 229/33 |

FOREIGN PATENT DOCUMENTS

| | | | |
|---|---|---|---|
| 862060 | 3/1961 | United Kingdom | 229/6 A |

*Primary Examiner*—William Price

*Attorney, Agent, or Firm*—Evelyn M. Sommer

[57] ABSTRACT

A stackable carton having a lid and tray is formed from planar folded blanks of corrugated board. The tray has recesses on its lower end edges and tabs in alignment therewith on its upper end wall edges. The lid when assembled on the tray has openings aligned with the tray tabs such that the tabs pass through the lid and extend upwardly for receipt in the recesses in the lower end edges of a like carton stacked thereon.

10 Claims, 3 Drawing Figures

10
118
50
142
72
120
138
62
14
74
122
76
56
24
18
100
80
28
68
104
64
16
20
70
52
54
144
22
140
84
42
46
12
70
26
49
30
19

STACKABLE CARTON WITH LID

BACKGROUND OF THE INVENTION

This application describes an invention which is a stackable corrugated board carton which includes a tray and lid therefor for fruit or like perishables and is a continuation-in-part of U.S. patent application Ser. No. 89,885, entitled "STACKABLE CARTON FOR PERISHABLE COMMODITIES," filed Oct. 31, 1979, by William F. Cornell, John P. Vear and E. Anthony Pascuzzi, and assigned to the same assignee as the present invention. U.S. patent application Ser. No. 89,886, now abandoned, is itself a continuation-in-part of U.S. patent application Ser. No. 836,612, filed Aug. 24, 1978, now U.S. Pat. No. 4,175,691.

This invention relates to a new and improved stackable carton with a lid and comprises a tray and a cover for the tray and blanks for forming the same. The blanks are planar sheets or corrugated board which are folded and secured to form a stackable tray having upstanding tabs and a lid for closing engagement therewith with openings through which said tabs extend. The bottom of the tray is provided with recesses in alignment with the tabs so that when a plurality of the covered cartons are stacked, the tabs of the lower carton are received in recesses of the carton stacked immediately above it. The ends of the tray include reinforcing panels.

The primary purpose of the stackable container of the invention is for the transportation of items of fresh fruit. Accordingly, the tray and lid thereof contain vent openings and give the advantage that an additional panel for air circulation is provided by the assembled tray and lid for easier and faster fruit cooling.

BRIEF DESCRIPTION OF THE INVENTION

The carton of the invention is preferably of a rectangular shape. The tray of the stackable carton of the invention accordingly gives an advantage in that only a single pass through an adhesive applicator device is required to provide adhesively connected end wall assemblies. The tray blank is characterized by a generally rectangular floor panel having first and second generally rectangular side wall panels extending from fold lines defining a pair of opposite sides of the floor panel. The first and second side wall panels have, respectively, first and second pairs of side wall flaps at their ends. A flap of each of said pairs extends from a fold line defining an end of one of said side wall panels. Each of the side wall flaps may optionally include a projection defining at least a half of a tab extending upwardly from an upper edge thereof and a recess at its lower edge in vertical alignment with the projection.

First and second generally rectangular end wall panels extend from opposite ends of the floor panel. Each of the end wall panels has at least one recess or angular cut at its lower edge. The floor panel end edges also have at least one opening therein such that the end wall panel recesses and the floor panel end edge openings are in vertical alignment with end wall tabs and associated side wall flap tabs, if any, when the blank is folded to form the tray of the stackable carton. Rectangular reinforcement boards substantially the size of the rectangular tray end wall panels are adhesively attached in face-to-face relation to the inside of the tray side wall flaps. The reinforcement boards are preferably of particle board but may be of wax impregnated corrugated board.

The cover or lid of the tray is also of a rectangular shape, and although it is not dimensioned precisely to the tray, it is slightly large and geometrically similar. The lid has a rectanguar lid to panel hingedly connected by fold lines to a pair of opposed lid side walls and a pair of opposed lid end walls. The lid side walls have fold lines perpendicular to their length defining opposite end edges thereof. First and second pairs of lid sidewall flaps are provided and each pair member extends outwardly from one of the fold lines which defines an end of one of the side wall panels. Each of the lid end walls have a lid end wall reinforcing panel extending from a double fold line defining its outer edge. The lid end wall reinforcing panels have tabs extending from their outer edges for engagement with openings aligned therewith and located in and along the end edges of the lid to a panel. Each of the end wall reinforcement panels of the lid also has at least one recess for aligment with the tray end wall tabs and associated tabs defined by the upper edges of the carton tray side wall flaps. Moreover, the lid to panel has corresponding openings which are adjacent the lid top panel ends through which the tray end wall tabs and tray side wall flap tabs pass and extend when the lid is on the panel tray, in order that said tabs may project or extend into the aligned recesses or openings provided in the end edges of the tray bottom panel and tray and wall panels of a like carton stacked thereupon.

DETAILED DESCRIPTION OF THE ILLUSTRATED EMBODIMENT

Figure 1:
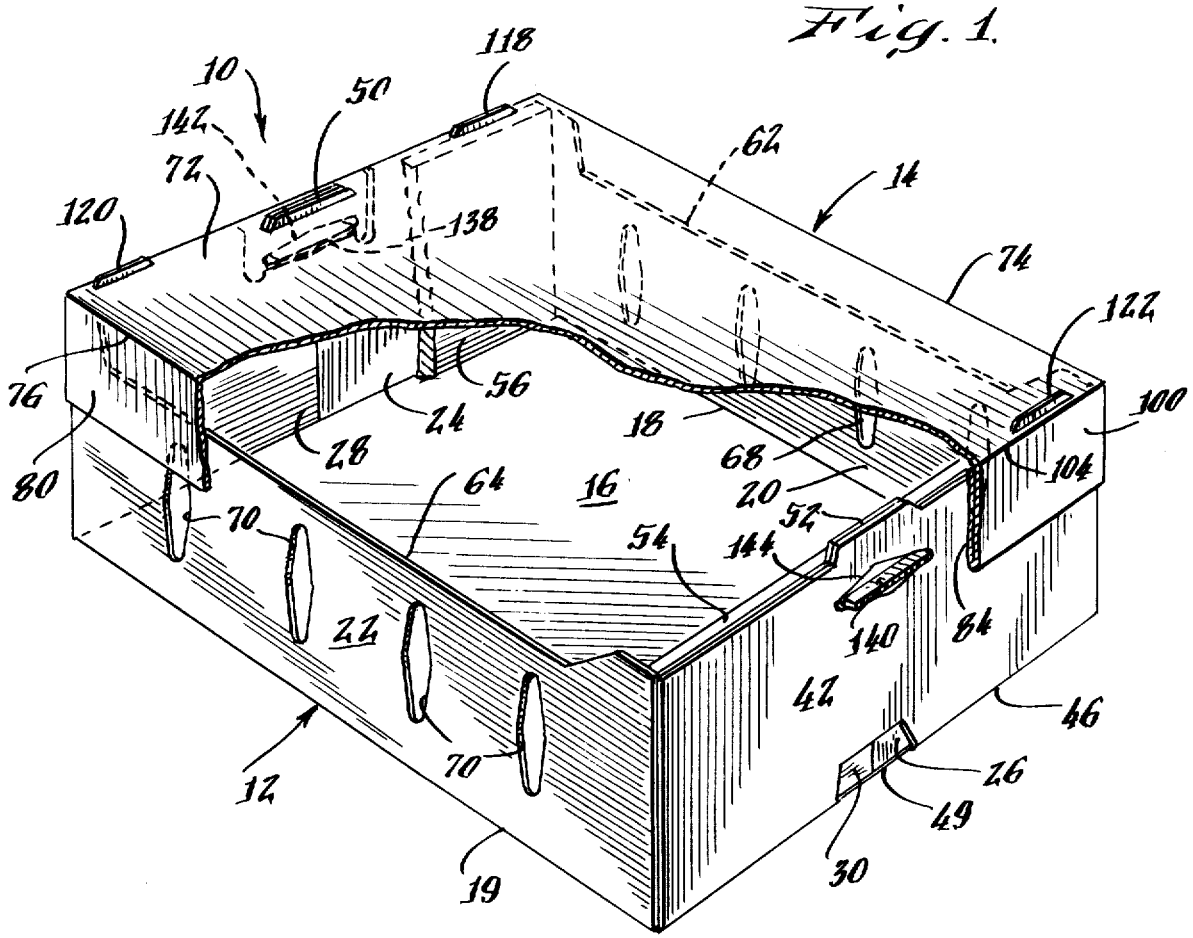
FIG. 1 is a perspective view with portions broken away of a carton including a tray and a lid therefor made in accordance with the principles of this invention.

The numeral 10 generally designates a reinforced stackable corrugated board carton including a tray and a lid therefor constructed in accordance with the principles of the invention.

The carton 10 includes a tray 12 and a lid or cover 14 therefor. The carton 10 is particularly adopted for the storage and transport of fruit or like perishables and is designed to enhance the circulation of air around fruit carried or stored therein.

The lid 12 includes a rectangular floor panel 16 having side edges 18 and 19 defined by fold lines. Extending from the side edges 18 and 19 of the floor panel 16 are side wall panels 20 and 22. The side wall panels 20 and 22 have pairs of side wall flaps 24, 26 and 28, 30, respectively. The side wall flaps 24 and 26 extend from the ends of the side wall panel 20 as defined by fold lines 32 and 34, respectively, and the side wall flaps 28 and 30 extend from the ends of side wall panel 22 as defined by fold lines 36 and 38, respectively. The fold lines 32, 34, 36 and 38 are perpendicular to the fold lines 18 and 20.

Tray end wall panels 40 and 42, respectively, extend beyond the ends of the tray floor panel 16, and are connected thereto by means of common fold lines 44 and 46. Along the fold lines 44 and 46, intermediate end ends thereof, are openings 48 and 49 for purposes which will be described in detail later. Opening 48 defines a recess in panel 42 and a recess in panel 16. Opening 49 defines a recession panel 40 and a recess in panel 16.

Aligned with the openings 48 and 49, and located on the outer edges of the end wall panels 40, 42, are tabs 50 and 52. When the tray blank 12 is folded into the shape of the carton tray, rectangular end reinforcing boards 54 and 56 of a dimension slightly smaller than end wall panels 40 and 42 are adhesively attached in face-to-face relation to the inside of the side wall flaps. The reinforcement boards 54 and 56 are preferably of particle board but may be of wax impregnated corrugated board. The top edge of board 54 and a fragment of board 56 are seen in FIG. 1.

Figure 2:
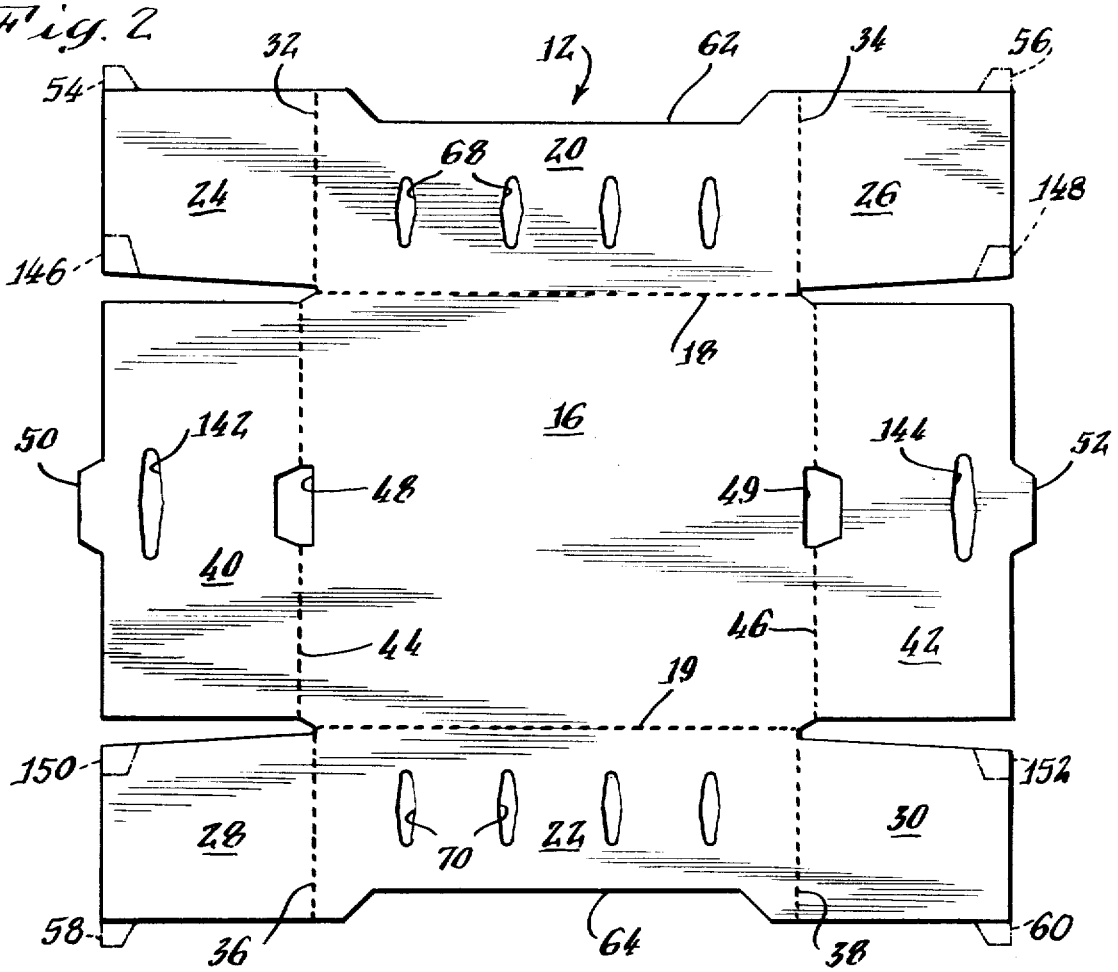
FIG. 2 is a plan view of the blank of the carton tray of FIG. 1.

The outer edges of the tray side wall panels 20 and 22 include recesses 62 and 64, respectively, which together with openings 68 in side wall panel 20, and openings 70 in side wall panel 22, provide for increased air circulation about fruit contained in the carton 10. Side wall flaps may include tabs 54, 56, 58 and 60 show in phantom in FIG. 2.

Figure 3:
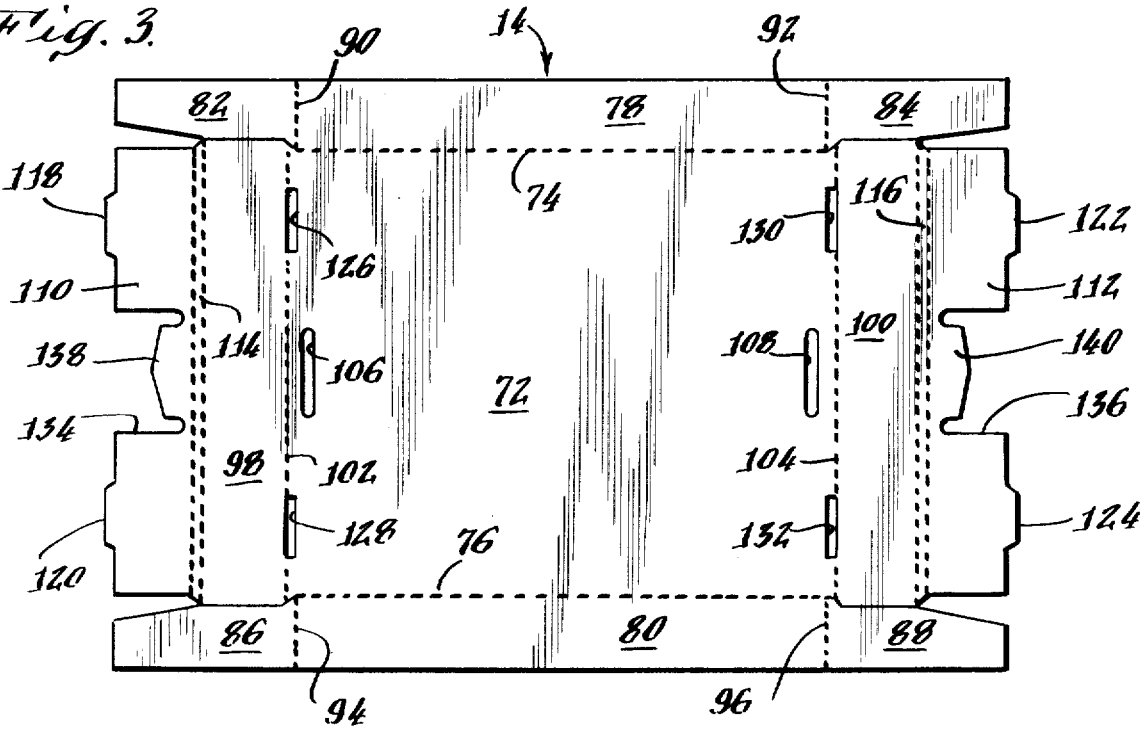
FIG. 3 is a plan view of the blank of the carton lid for the carton tray formed from the blank of FIG. 2.

The blank of the carton cover or lid 14 is illustrated in FIG. 3 and includes a lid top panel 72. The lid top panel 72 has side edges defined by fold lines 74 and 76, respectively, with lid side wall panels 78 and 80, respectively, extending outwardly therefrom. Each of the lid side wall panels 78 and 80 have a pair of lid side wall panel flaps 82, 84 and 86, 88, respectively, extending from the ends thereof which are defined by perpendicular fold lines 90, 92, and 94, 96, respectively. At the end edges of the lid floor panel 72, lid end wall panels 98 and 100 extend outwardly. The end wall panels 98 and 100, respectively, have common fold lines 102 and 104 with the lid top panel 72. Aligned openings 106 and 108 are provided in the lid top panel 72 adjacent its end edges as defined in fold lines 102 and 104.

Lid end wall reinforcement panels 110, 112 extend outwardly beyond double fold lines 114 and 116 at the outer edges respectively of end wall panels 98 and 100. The end wall reinforcement panels 110 and 112 include securing tabs 118, 120 and 122, 124, respectively. These securing tabs are in alignment with and received in openings 126 and 128 along fold line 102, and 130 and 132 along fold line 104. The lid end wall reinforcement panels 110 and 112 include recesses 134 and 136, respectively, along their outer edges in alignment with the openings 106 and 108 in the lid top panel 72. When lid 14 is assembled on tray 12; lid openings 106 and 108 are in alignment with the tray tabs 50, 52 and associated projections 54, 56, 58 and 60.

Within the lid recesses 134 and 136 are projections 138 and 140 which can be bent inwardly to be secured into openings 142 and 144, respectively, in tray end wall panels 40 and 42. This secures the lid 14 upon the tray 12 and prevents disassembly of the carton inadvertently as by wind or other forces accidentally applied.

When the carton is assembled with the lid 14 telescopically assembled on the top of the tray 12, the recesses 62 and 64 in association with the lid side wall panels 78 and 80 create a large vent for increased air circulation to cool the fruit stored therein. When several of the cartons 10 constructed according to the invention are stacked one upon the other, aligned tabs 50 and 52, which may be reinforced by tabs formed by the projections 54, 56, 58 and 60 are received in the openings 48 and 49 along the lower tray edges defined by fold lines 44 and 46 of the carton below it. Recess portions 146, 148, 150 and 152 shown in phantom in FIG. 2 may be provided in the lower edges of the tray side wall flaps 24, 26, 28 and 30, respectively, also to provide clearance therefor.

The folded tray 12 is maintained in erected position by adhesive applied to the outside of flaps 24, 25, 28 and 30 on a single pass through a standard adhesive applying machine. The lid flaps 82, 84, 86 and 88 may also have adhesive applied to them to ensure that lid 13 is maintained in its properly erected condition.

Thus, it will be seen that a stackable container for the storage and transportation of items of fresh fruit is provided which includes a tray and lid therefor, the combination of which provides both easy erection and assembly and additional air circulation for easier and faster fruit cooling.

What is claimed is:

1. A closed stackable carton having a tray portion and a lid portion comprising in combination:

a tray made from a blank having a rectangular floor panel;

first and second generally rectangular tray side wall panels extending from fold lines defining a pair of opposite sides of said floor panel;

first and second pairs of tray side wall flaps extending from fold lines which define the ends of the side wall panels;

each tray side wall flap including a projection at the extreme free end defining at least a half of a tab for extending upwardly from an upper edge of said flap and a corresponding recess at the extreme free end of the lower edge of said flap in vertical alignment with said projection;

first and second generally rectangular tray end wall panels extending from fold lines defining a pair of opposite ends of said floor panel;

each of said tray end wall panels having at least one recess at its lower edge to correspond with a recess defined in the lower edge of said tray side wall flaps in vertical alignment with said projections in the upper edges of said flaps when said tray blank is folded to form the tray of the stackable carton;

a lid made from a blank having a rectangular top panel slightly larger than the floor panel of said tray;

first and second generally rectangular lid side wall panels extending from fold lines defining a pair of opposite sides of said top panel;

first and second pairs of lid side wall flaps extending outwardly from fold lines defining the ends of the lid side wall panels;

first and second lid end panels extending from fold lines defining a pair of opposite ends of said top panel;

said lid top panel having openings formed therein adjacent the lid top panel ends in alignment with said tray tabs on said end wall panels and defined by the projections on the upper edges of said side panel flaps for receiving said tray tabs when said tray blank is folded to form the tray of the stackable carton and the lid blank is folded to form the lid therefor and assembled with the tray to complete the closed restackable carton.

2. The closed stackable carton of claim 1 in which a lid end wall reinforcement panel extends from each of the fold lines defining the outer edges of each of the lid end panels.

3. The closed stackable carton of claim 2 in which the end wall reinforcement panels have recesses which are in alignment with the openings in said lid top adjacent the lid top panel ends through which tabs projecting from the tray end wall panels and side wall flaps pass and extend.

4. The closed stackable carton of claim 3 in which the lid end wall reinforcement panels have tabs on their outer ends in alignment with openings therefor provided in the lid top panel adjacent its end edges.

5. The closed stackable carton of claim 1 in which the side wall panels of the carton tray include recesses on their outer edges to enhance air circulation in the carton.

6. The closed stackable carton of claim 1 in which the side wall panels of the carton tray include openings to enhance air circulation in the carton.

7. The closed stackable carton of claim 1 in which rectangular reinforcement boards substantially the size of the rectangular tray end wall panels are adhesively attached in face-to-face relation to the inside of the tray side wall flaps.

8. The closed stackable carton of claim 7 in which the rectangular reinforcement boards are made of particle board.

9. A closed stackable carton having a tray portion and a lid portion comprising in combination:

a tray made from a blank having a rectangular floor panel;

first and second generally rectangular tray side wall panels extending from fold lines defining a pair of opposite sides of said floor panel;

first and second pairs of tray side wall flaps extending from fold lines which define the ends of the side wall panels;

each tray side wall flap including a projection at the extreme free end defining at least a portion of a tab for extending upwardly from an upper edge of said flap and a corresponding recess at the extreme free end of the lower edge of said flap in vertical alignment with said projection;

first and second generally rectangular tray end wall panels extending from fold lines defining a pair of opposite ends of said floor panel;

at least one recess adjacent said fold lines defining said pair of opposite ends of said floor panel in vertical alignment with said projections in the upper edges of said flaps when said tray blank is folded to form the tray of the stackable carton;

a lid made from a blank having a rectangular top panel slightly larger than the floor panel of said tray;

first and second generally rectangular lid side wall panels extending from fold lines defining a pair of opposite sides of said top panel;

first and second lid end panels extending from fold lines defining a pair of opposite ends of said top panel;

means for joining adjacent ends of said lid side wall panels and said lid end wall panels;

said lip top panel having openings formed therein adjacent the lid top panel ends in alignment with said tray tabs when said tray blank is folded to form the tray of the stackable carton and the lid blank is folded to form the lid therefor and assembled with the tray to complete the closed restackable carton.

10. A closed stackable carton having a tray portion and a lid portion comprising in combination:

a tray made from a blank having a rectangular floor panel;

first and second generally rectagular tray side wall panels extending from fold lines defining a pair of opposite sides of said floor panel;

first and second pairs of tray side wall flaps extending from fold lines which define the ends of the side wall panels; each tray side wall flap including a projection at the extreme free end defining at least a half of a tab for extending upwardly from an upper edge of said flap and a corresponding recess at the extreme free end of the lower edge of said flap in vertical alignment with said projection;

first and second generally rectangular tray end wall panels extending from fold lines defining a pair of opposite ends of said floor panel;

each tray end wall panel including a projection extending upwardly from an upper edge of said tray end wall panel;

a corresponding opening in said floor panel adjacent the lower edge of each of said end wall panels in vertical alignment with said projections;

a lid made from a blank having a rectangular top panel slightly larger than the floor panel of said tray;

first and second generally rectangular lid side wall panels extending from fold lines defining a pair of opposite sides of said top panel;

first and second pairs of lid side wall flaps extending outwardly from fold lines defining the ends of the lid side wall panels;

first and second lid end panels extending from fold lines defining a pair of opposite ends of said top panel;

said lid top panel having openings formed therein adjacent the lid top panel ends in alignment with the projections on the upper edges of said tray end wall panels for receiving said projections when said tray blank is folded to form the tray of the stackable carton and the lid blank is folded to form the lid therefor and assembled with the tray to complete the closed restackable carton.

* * * * *